US005267844A

United States Patent [19]

Grassbaugh et al.

[11] Patent Number: 5,267,844

[45] Date of Patent: Dec. 7, 1993

[54] COMPRESSOR ASSEMBLY WITH STAKED SHELL

[75] Inventors: Walter T. Grassbaugh; Dilip S. Sathe, both of Sidney, Ohio

[73] Assignee: Copeland Corporation, Sidney, Ohio

[21] Appl. No.: 867,968

[22] Filed: Apr. 13, 1992

[51] Int. Cl.[5] ..... F04B 39/12

[52] U.S. Cl. ..... 417/410R; 417/902

[58] Field of Search ..... 417/410, 902; 92/171.1; 29/516; 418/55.1

[56] References Cited

U.S. PATENT DOCUMENTS

| | | | |
|---|---|---|---|
| 2,630,964 | 3/1953 | Scheldorf | 417/902 |
| 3,754,844 | 8/1973 | Nusser et al. | 417/423.12 |
| 3,811,367 | 5/1974 | Bimba . | |
| 3,886,849 | 6/1975 | Roberts et al. . | |
| 4,526,522 | 7/1985 | Onoda . | |
| 4,544,334 | 10/1985 | Ellis . | |
| 4,733,456 | 3/1988 | Sofianek et al. . | |
| 4,780,953 | 11/1988 | Wheeler et al. . | |
| 5,141,420 | 8/1992 | Nambiar | 417/902 |

FOREIGN PATENT DOCUMENTS

| | | | |
|---|---|---|---|
| 0255591 | 10/1988 | Japan | 417/902 |

*Primary Examiner*—Richard A. Bertsch
*Assistant Examiner*—David W. Scheuermann
*Attorney, Agent, or Firm*—Harness, Dickey & Pierce

[57] ABSTRACT

A means for attaching the bearing housing to an outer shell is disclosed. The outer shell is plastically deformed into a plurality of apertures formed into the bearing housing. The deformation of the shell is such that material is displaced into the aperture of the bearing housing member without penetrating through the wall of the shell, thus maintaining the integrity of the shell. The shape of the displaced material of the shell is such that a generally cylindrical load bearing surface having a sharp corner is created which is capable of withstanding both axially and circumferentially directed forces of substantial magnitude.

20 Claims, 2 Drawing Sheets

COMPRESSOR ASSEMBLY WITH STAKED SHELL

BACKGROUND OF THE INVENTION

The present invention relates to hermetically sealed compressor assemblies. More particularly, the present invention relates to hermetically sealed compressor assemblies having a shell which is staked in place in a unique manner to resist excessive axial and circumferential loading.

Hermetically sealed motor compressors of various designs are well known in the art. These designs include both the piston/cylinder types and scroll types. While the present invention applies equally well to all of the various designs of motor compressor units, it will be described for exemplary purposes embodied in a hermetically sealed scroll type fluid machine.

A scroll type fluid machine has a compressor section and an electrical motor section mounted in a hermetic shell with fluid passages being formed through the walls of the hermetic shell. The fluid passages are normally connected through pipes to external equipment such as, for example, an evaporator and condenser when the machine is used in a refrigeration system.

The scroll type compressor section has a compressor which is comprised of a non-orbiting scroll member which is mated with an orbiting scroll member. These scroll members have spiral wraps formed in conformity with a curve usually close to an involute curve so as to protrude upright from end plates. These scroll members are assembled together such that their wraps mesh with each other to form therebetween compression chambers. The volumes of these compression chambers are progressively changed in response to an oebital movement of the orbiting scroll member. A fluid suction port communicates with a portion of the non-orbiting scroll member near the radially outer end of the outermost compression chamber, while a fluid discharge port opens in the portion of the non-orbiting scroll member close to the center thereof. An Oldham's ring mechanism is placed between the orbiting scroll member and the non-orbiting scroll member so as to prevent the orbiting scroll member from rotating about its own axis.

The non-orbiting scroll member is secured to the main bearing housing by means of a plurality of bolts extending therebetween which allow limited relative axial movement between the bearing housing and the non-orbiting scroll member. The attachment for the non-orbiting scroll member is more fully disclosed in assignee's copending application Ser. No. 07/591,444 entitled "Non-Orbiting Scroll Mounting Arrangements for a Scroll Machine" filed Oct. 1, 1990, the disclosure of which is hereby incorporated herein by reference.

The orbiting scroll member is driven by a crankshaft so as to produce an orbiting movement with respect to the stationary scroll member. Consequently, the volumes of the previously mentioned chambers are progressively decreased to compress the fluid confined in these chambers, and the compressed fluid is discharged from the discharge port as the compression chambers are brought into communication with the discharge port. The housing is fixedly attached to the hermetic shell. The attachment methods for connecting the housing to the hermetic shell include bolting, pin or plug welding and/or press or shrink fitting. While each of these methods offer certain advantages, they also come with individual disadvantages.

The press or shrink fit is the least expensive attachment method and it is capable of withstanding most of the forces normally generated by the assembly. The compressor assembly is capable, however, under certain conditions, of generating forces which could exceed the holding capabilities of the press fit design. When these excessive forces are generated, the housing could slip either axially or circumferentially with respect to the hermetic shell, adversely affecting the operation of the compressor assembly.

Welding of the housing resolves the issues of being able to withstand the forces in excess of the normal, but the cost of producing a welded assembly in volume production is relatively high.

Bolting the housing to the shell will also resolve the issue of being able to withstand the forces in excess of normal, but the cost involved in preparing both the shell and the internal components to be able to accommodate a bolt and still maintain the necessary hermetic seal makes the technique unsuitable to volume production. In addition, the problems of properly completing the fastening operation and the costs associated with the fastener make this an undesirable option.

Accordingly, what is needed is a means of fixedly attaching the housing of a motor compressor unit to the hermetic shell which is capable of withstanding both the normal and the abnormal forces generated during the operation of the compressor. The means of fixedly attaching the housing should be both inexpensive and reliable, and suitable for high volume production.

SUMMARY OF THE PRESENT INVENTION

The present invention provides the art with a means for attaching the housing to the hermetic shell of a motor compressor which is inexpensive, reliable and capable of withstanding both the normal and abnormal forces generated during the operation of the motor compressor.

The hermetic shell of the present invention is plastically deformed into a plurality of apertures formed into the housing of the motor compressor unit. The deformation of the shell is such that material is displaced into the aperture without penetrating through the wall of the hermetic shell, thus maintaining the hermetic integrity of the sealed chamber. The shape of the displaced material of the shell and the aperture is such that a generally cylindrical load bearing interface is created which is capable of withstanding both axially and circumferentially directed forces.

Further objects, features and advantages of the present invention will become apparent from the analysis of the following written specification, the appended claims and the accompanying drawings:

DETAILED DESCRIPTION OF THE PREFERRED EMBODIMENT

Figure 1:
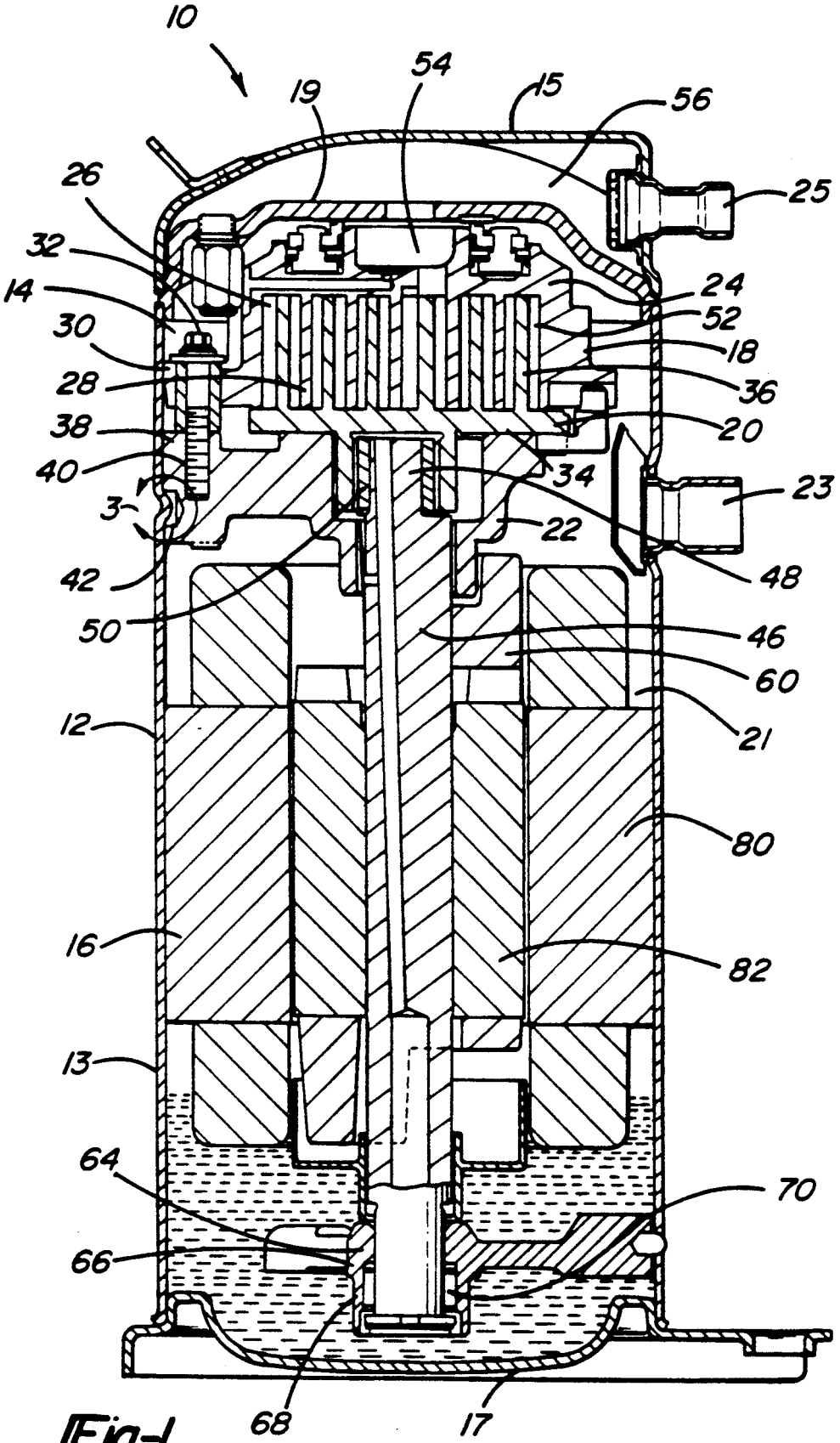
FIG. 1 is a side elevation view partially in cross section of a hermetically sealed compressor in accordance with the present invention.

The present invention is illustrated for exemplary purposes in conjunction with a hermetically sealed scroll compressor. It is to be understood that the invention is not limited to a scroll compressor and it is possible to utilize the staked configuration on virtually any type of motor compressor or similar machine.

Referring to the drawings, a scroll type fluid machine 10 in accordance with the present invention, which is in this case a compressor of a refrigeration system, is shown. The fluid machine 10 is comprised of a hermetic shell assembly 12, a compressor section 14 and a motor drive section 16. The hermetic shell assembly 12 is comprised of lower shell 13, an upper cap 15, a bottom cover 17 and a separation plate 19. The bottom cover 17, the lower shell 13, the separation plate 19 and the upper cap 15 are fixedly and sealingly attached in the manner shown by welding during assembly of the fluid machine 10 to form sealed suction chamber 21 and a discharge chamber 56. The hermetic shell 12 further has an inlet fitting 23 and an outlet fitting 25.

The compressor section 14 is comprised of a non-orbiting scroll member 18, an orbiting scroll member 20 and a bearing housing 22. The non-orbiting scroll member 18 is comprised of an end plate and body 24 having a chamber 26 in which is disposed a spiral wrap 28. The non-orbiting scroll has a plurality of embossments 30 which are adapted to be attached to the bearing housing 22 by bolts 32.

The orbiting scroll member 20 is comprised of an end plate 34 and a spiral wrap 36 which extends upright from the end plate 34 into chamber 26. The spiral wrap 36 is meshed with the spiral wrap 28 of the non-orbiting scroll member 18 in the usual manner to form in combination with the bearing housing 22, a compressor section 14 of the fluid machine 10. Closed chambers 52 are defined by the meshing wraps 28 and 36 and the arrangement is in communication with the usual discharge port 54 formed in the central position of the non-orbiting scroll 18. The discharge port 54 communicates with discharge chamber 56 formed by separation plate 19 and upper cap 15.

The bearing housing 22 has a plurality of (3 or 4) radially outwardly extending lobes 38 affixed to the hermetic shell assembly 12. The lobes 38 of the bearing housing align with the embossments 30 of the non-orbiting scroll member 18 and have threaded holes 40 for accepting bolts 32 to attach the non-orbiting scroll member 18 as described above. At its outer end, each lobe 38 has a cylindrical recess 42 disposed therein.

The compressor section 14 further includes a crankshaft 46 having an eccentric shaft portion 48 coupled to the orbiting scroll member 20 through a drive bushing and bearing assembly 50. A counter-balance weight 60 is fixed to the crankshaft 46, which is supported at its lower end by lower bearing assembly 64. Lower bearing assembly 64 is fixedly secured to shell assembly 12 and has a center portion 66 having an elongated bore 68 in which is disposed a journal bearing 70 which is designed to receive the lower end of crankshaft 46.

The motor drive section 16 is comprised of a motor stator 80 securely mounted in the lower shell 13, preferably by press fitting, and a motor rotor 82 coupled to the crankshaft 46 of the compressor section 14.

Figure 3:
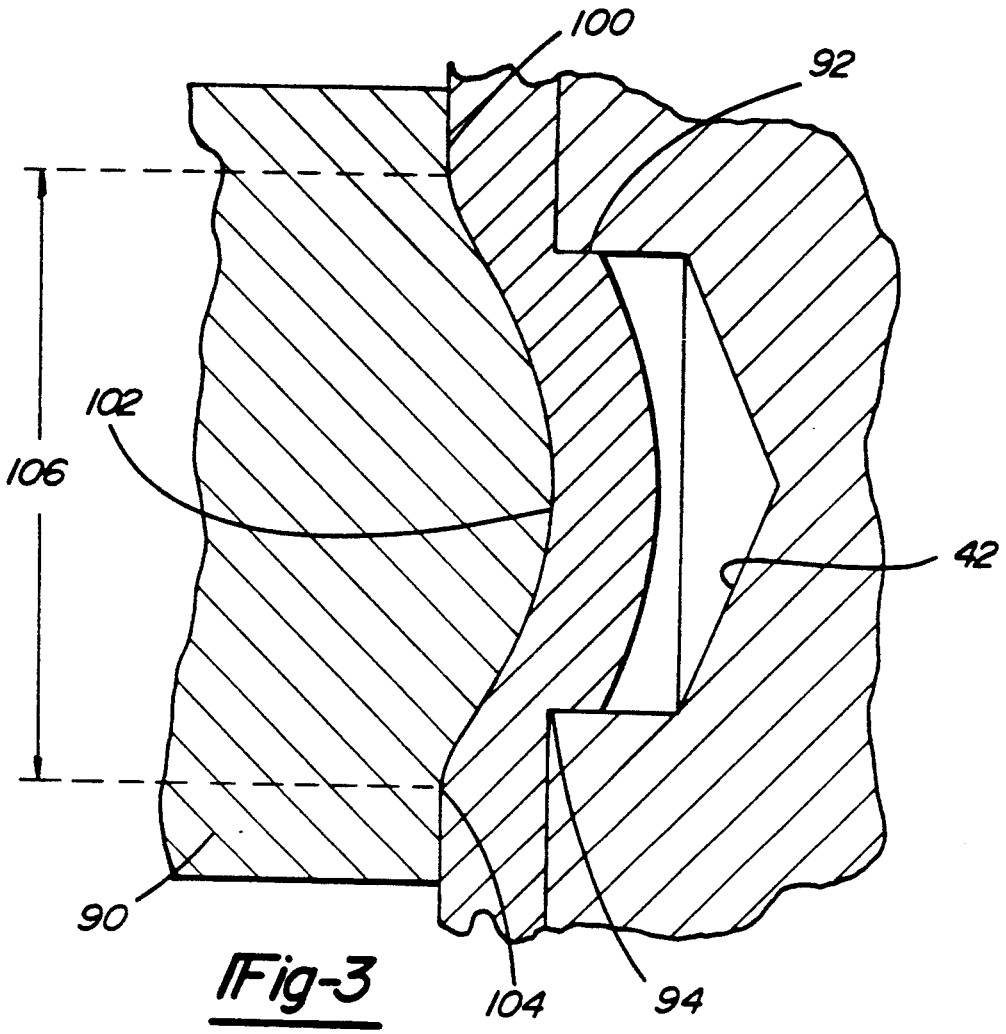
FIG. 3 is a further enlarged view of the shape of the staked area designated in FIG. 1 by circle 3—3 in accordance with the present invention.

The lobes 38 of the bearing housing 22 are press fit into the inside diameter of the hermetic shell assembly 12. After proper positioning of the bearing housing 22 inside the lower shell 13, a staking tool 90, is forced radially inwardly against the shell to plastically deform the lower shell 13 in each of the areas of the recesses 42 to form a plurality of circular staked portions 92, as best shown in FIG. 3. The lower shell 13 is deformed sufficiently to cause the edge 94 of recess 42 to bite into the shell metal to form a cylinder retention surface 92, but the plastic deformation of the upper shell is not sufficient to affect the hermetic seal of the sealed chamber 21 by overly weakening or piercing through the shell material. During operation of the scroll type fluid machine, the forces generated by the operation of the compressor in both the axial and circumferential directions must be accommodated by the joints between lobes 38 and lower shell 13. The recesses 42 are preferably sufficient in size and number to support the maximum anticipated abnormal forces which may be generated.

Figure 2:
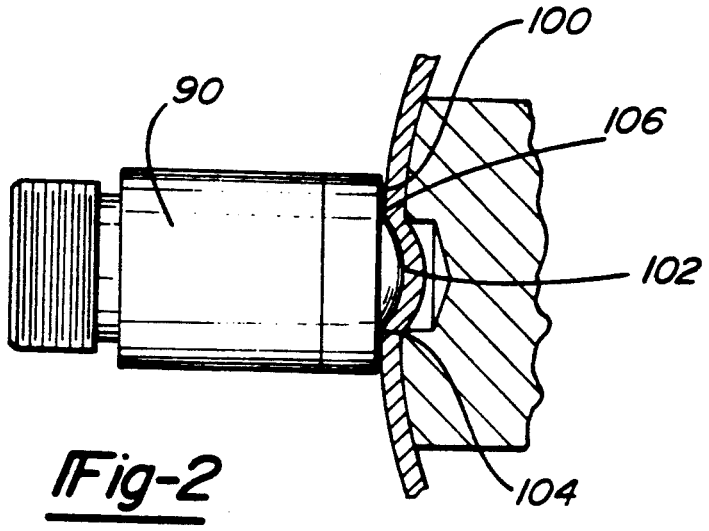
FIG. 2 is an enlarged view of the tool which is used to create the staking forming a part of the present invention.

The staking tool 90 is shown in FIGS. 2 and 3 and comprises a generally flat annular circular surface 100 having a spherical surface 102 extending therefrom. A radiused section 104 blends the area where spherical surface 102 meets the annular surface 100. The circular diameter 106 where these two surfaces meet is referred to as the base diameter.

It has been found that with a shell material of draw quality hot rolled steel that very satisfactory results have been obtained when the base diameter 106 is equal to 1.30 to 1.35 times the diameter of the recess 42 formed in the bearing housing 22. The distance which spherical surface 102 extends from the flat circular surface 100 is termed the nose height. It has been found that the nose height should be approximately equal to the thickness of the material used to manufacture the lower shell 13 which is the material being staked. Finally, the radius of spherical surface 102 is termed the nose radius and it should be equal to approximately 0.85 times the diameter of the recess 42. By following the above guidelines, a staked area similar to that shown in FIG. 2 will be achieved. The width of the circular retention surface 92 is equal to approximately one-third of the thickness of the material used to manufacture the lower shell 13 which is the material being staked.

Specifically, the scroll type fluid units 10 which were tested and found to be the most reliable had an lower shell 13 thickness of approximately 3.00 millimeters. The bearing housing 22 had four recesses 42 each having a diameter of approximately 12.70 millimeters. The bearing housing 22 was press fit into the lower shell 13 having an interference fit of 0.20/0.46 millimeters by a hydraulic press using approximately 2000 pounds of force. This lower shell 13 was then staked into the four 12.70 millimeter diameter recesses 42 with four staking tools 90 each having a base diameter 106 of approximately 16.764 millimeters, a nose height of approximately 3.045 millimeters and a nose radius of approximately 10.80 millimeters. This produced the staking configuration shown in FIGS. 2 and 3 having a cylindrical retention surface 92 which was 1.0 to 1.3 millimeters in width.

While it will be apparent that the preferred embodiment of the invention disclosed is well calculated to provide the advantages above stated, it will be appreciated that the invention is susceptible to modification, variation and change without departing from the proper scope or fair meaning of the subjoined claims.

What is claimed is:

1. A powered work producing apparatus comprising:

a shell;

a powered mechanism for performing work disposed in said shell, said powered work mechanism having a housing, said housing having an outside surface and defining a longitudinal axis;

at least one mechanical connection between said shell and said housing, said mechanical connection comprising a recess in said housing and an inwardly deformed portion of said shell disposed in said recess, said recess having a surface disposed generally perpendicular to said outside surface of said housing, said surface in cooperation with said inwardly deformed portion of said shell operate to resist rotational movement of said shell with respect to said housing.

2. A hermetic motor compressor comprising:

a shell defining a longitudinal axis;

a compressor disposed in said shell, said compressor having a housing maintained in position in said shell against normal forces created under normal operating conditions by a press fit between the exterior of said housing and the inside of said shell, said housing having an outer surface;

at least one mechanical connection between said shell and said compressor housing, said mechanical connection comprising a recess in said housing and an inwardly deformed portion of said shell disposed in said recess, said recess having a surface disposed generally perpendicular to said outside surface of said housing, said surface in cooperation with said inwardly deformed portion of said shell operative to resist rotational movement of said shell with respect to said housing said mechanical connection providing a sufficient holding power to resist significant forces in excess of said normal forces; and a motor disposed in said shell for powering said compressor.

3. A hermetic motor compressor as claimed in claim 2 further comprising a drive shaft for powering said compressor, said drive shaft being journalled in said housing.

4. A hermetic motor compressor as claimed in claim 2 wherein said compressor is a rotary compressor.

5. A hermetic motor compressor as claimed in claim 4 wherein said compressor is a scroll type compressor.

6. A hermetic motor compressor comprising:

a shell defining a longitudinal axis;

a compressor disposed in said shell, said compressor having a housing maintained in position in said shell against normal forces created under normal operating conditions by a press fit between the exterior of said housing and the inside of said shell, said housing having an outer surface;

at least one mechanical connection between said shell and said compressor housing, said mechanical connection comprising a recess in said housing and an inwardly deformed portion of said shell disposed in said recess, said recess in said housing having a cylindrical inner surface, said inwardly deformed portion of said shell having a partially spherical surface and a partially cylindrical surface, said partially cylindrical surface being in intimate contact with said cylindrical inner surface of said recess, said cylindrical inner surface disposed generally perpendicular to said outside surface of said housing, said cylindrical inner surface in cooperation with said inwardly deformed portion of said shell operative to resist rotational movement of said shell with respect to said housing, said mechanical connection providing sufficient holding power to resist significant forces in excess of said nominal forces; and a motor disposed in said shell for powering said compressor.

7. The hermetic motor compressor as claimed in claim 6 wherein said partially cylindrical surface of said inwardly deformed portion of said shell is formed by the plastic deformation of the material of said shell.

8. A hermetic motor compressor as claimed in claim 2 wherein said shell is elongated with said motor being disposed axially with respect to said compressor.

9. A hermetic motor compressor as claimed in claim 8 wherein said forces are in the axial direction.

10. A hermetic motor compressor as claimed in claim 8 wherein said forces are in a circumferential direction with respect to said longitudinal axis of said shell.

11. A hermetic motor compressor as claimed in claim 8 wherein said forces are in axial and circumferential directions with respect to said longitudinal axis of said shell.

12. A hermetic motor compressor comprising:

a shell defining a longitudinal axis;

a compressor disposed in said shell, said compressor having a housing, said housing having an outer surface;

at least one mechanical connection between said shell and said compressor housing, said mechanical connection comprising a recess in said housing and an inwardly deformed portion of said shell disposed in said recess, said recess having a surface disposed generally perpendicular to said outside surface of said housing, said surface in cooperation with said inwardly deformed portion of said shell operative to resist rotational movement of said shell with respect to said housing, said mechanical connection providing sufficient holding power to resist significant forces created during operation of said compressor; and a motor disposed in said shell for powering said compressor.

13. A hermetic motor compressor as claimed in claim 12 further comprising a drive shaft for powering said compressor, said drive shaft being journalled in said housing.

14. A hermetic motor compressor comprising:

a shell defining a longitudinal axis;

a compressor disposed in said shell, said compressor having a housing, said housing having an outer surface;

at least one mechanical connection between said shell and said compressor housing, said mechanical connection comprising a recess in said housing and an inwardly deformed portion of said shell disposed in said recess, said recess in said housing having a cylindrical inner surface, said inwardly deformed portion of said shell having a partially spherical surface and a partially cylindrical surface, said partially cylindrical surface being in intimate contact with said cylindrical inner surface of said recess, said cylindrical inner surface disposed generally perpendicular to said outside surface of said housing, said cylindrical inner surface in cooperation with said inwardly deformed portion of said shell operative to resist rotational movement of said shell with respect to said housing, said mechanical connection providing sufficient holding power to resist significant forces created during operation of said compressor; and a motor disposed in said shell for powering said compressor.

15. A hermetic motor compressor as claimed in claim 12 wherein said compressor is a rotary compressor.

16. A hermetic motor compressor as claimed in claim 15 wherein said compressor is a scroll type compressor.

17. A hermetic motor compressor as claimed in claim 12 wherein said shell is elongated with said motor being disposed axially with respect to said compressor.

18. A hermetic motor compressor as claimed in claim 17 wherein said forces are in the axial direction.

19. A hermetic motor compressor as claimed in claim 17 wherein said forces are in a circumferential direction with respect to said longitudinal axis of said shell.

20. A hermetic motor compressor as claimed in claim 17 wherein said forces are in axial and circumferential directions with respect to said longitudinal axis of said shell.

* * * * *

UNITED STATES PATENT AND TRADEMARK OFFICE

CERTIFICATE OF CORRECTION

PATENT NO. : 5,267,844

DATED : December 7, 1993

INVENTOR(S) : Walter T. Grassbaugh and Dilip S. Sathe

It is certified that error appears in the above-indentified patent and that said Letters Patent is hereby corrected as shown below:

Column 1, line 36, "oebital" should be -- orbital --.

Column 2, between lines 58 and 59, insert -- Description of the Drawings --

Signed and Sealed this

Twenty-first Day of June, 1994

*Attest:*

Bruce Lehman

BRUCE LEHMAN

*Attesting Officer*

*Commissioner of Patents and Trademarks*